US006551481B2

(12) United States Patent
Castegnier et al.

(10) Patent No.: US 6,551,481 B2
(45) Date of Patent: Apr. 22, 2003

(54) ELECTROCOAGULATION PRINTING METHOD AND APPARATUS PROVIDING COLOR JUXTAPOSITION

(75) Inventors: Adrien Castegnier, Outremont (CA); Guy Castegnier, Iles des Soeurs (CA)

(73) Assignee: Elcorsy Technology Inc., Saint-Laurent (CA)

( * ) Notice: Subject to any disclaimer, the term of this patent is extended or adjusted under 35 U.S.C. 154(b) by 0 days.

(21) Appl. No.: 09/934,467

(22) Filed: Aug. 23, 2001

(65) Prior Publication Data

US 2001/0052461 A1 Dec. 20, 2001

Related U.S. Application Data

(63) Continuation-in-part of application No. 09/774,059, filed on Jan. 31, 2001, now Pat. No. 6,458,261, which is a continuation-in-part of application No. 09/430,020, filed on Oct. 29, 1999, now Pat. No. 6,210,553.

(51) Int. Cl.[7] ..... C25D 13/04

(52) U.S. Cl. ..... 204/486; 204/483; 204/508; 204/623; 101/DIG. 29

(58) Field of Search ..... 204/486, 483, 204/508, 623; 101/DIG. 29

(56) References Cited

U.S. PATENT DOCUMENTS

| | | | | |
|---|---|---|---|---|
| 4,661,222 A | | 4/1987 | Castegnier | 204/180.9 |
| 4,895,629 A | | 1/1990 | Castegnier et al. | 204/180.9 |
| 5,538,601 A | | 7/1996 | Castegnier | 204/486 |
| 5,750,593 A | | 5/1998 | Castegnier et al. | 523/161 |
| 6,045,674 A | * | 4/2000 | Castegnier | 204/486 |

* cited by examiner

*Primary Examiner*—Kishor Mayekar

(57) ABSTRACT

A polychromic image is reproduced and transferred onto a substrate by (a) providing a positive electrolytically inert electrode having a continuous passivated surface moving at constant speed; (b) coating the positive electrode surface with an olefinic substance; (c) forming on the olefin-coated positive electrode surface a plurality of colored pixels representative of a desired polychromic image and each comprising juxtaposed dots of differently colored, coagulated colloid, by electrocoagulation of a colloid present in an electrocoagulation printing ink; and (d) bringing a substrate into contact with the colored pixels to cause transfer of the colored pixels from the positive electrode surface onto the substrate and thereby imprint the substrate with the polychromic image.

21 Claims, 4 Drawing Sheets

ELECTROCOAGULATION PRINTING METHOD AND APPARATUS PROVIDING COLOR JUXTAPOSITION

CROSS-REFERENCE TO RELATED APPLICATIONS

This application is a continuation-in-part of U.S. application Ser. No. 09/774,059 filed Jan. 31, 2001, now U.S. Pat. No. 6,458,261, which is a continuation-in-part of U.S. application Ser. No. 09/430,020 filed Oct. 29, 1999, now U.S. Pat. No. 6,210,553.

BACKGROUND OF THE INVENTION

The present invention pertains to improvements in the field of electrocoagulation printing. More particularly, the invention relates to an electrocoagulation printing method and apparatus providing color juxtaposition.

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is thereafter cleaned by means of a plurality of rotating brushes and a cleaning liquid to remove any residual coagulated colloid adhered to the surface of the positive electrode.

When a polychromic image is desired, the negative and positive electrodes, the positive electrode coating device, ink injector, rubber squeegee and positive electrode cleaning device are arranged to define a printing unit and several printing units each using a coloring agent of different color are disposed in tandem relation to produce several differently colored images of coagulated colloid which are transferred at respective transfer stations onto the substrate in superimposed relation to provide the desired polychromic image. Alternatively, the printing units can be arranged around a single roller adapted to bring the substrate into contact with the dots of colored, coagulated colloid produced by each printing unit, and the substrate which is in the form of a continuous web is partially wrapped around the roller and passed through the respective transfer stations for being imprinted with the differently colored images in superimposed relation.

A polychromic image can also be formed by providing a single positive electrode in the form of a revolving cylinder, arranging the negative electrodes, the positive electrode coating device, ink injector, rubber squeegee and positive electrode cleaning device to define a printing unit and disposing several printing units each using a coloring agent of different color around the positive cylindrical electrode to produce several differently colored images of coagulated colloid which are transferred at respective transfer stations from the positive electrode surface onto the substrate in superimposed relation to provide the desired polychromic image. The substrate which is in the form of a continuous web is partially wrapped around the positive electrode and passed through the respective transfer stations for being imprinted with the differently colored images in superimposed relation. This arrangement is described in Applicant's U.S. Pat. No. 5,538,601 of Jul. 23, 1996.

Since each printing unit of the above multicolor printing apparatus requires a positive electrode coating device and cleaning device, such an apparatus is not only cumbersome but also very costly. Moreover, since the differently colored images of coagulated colloid are transferred at respective transfer stations onto the substrate in superimposed relation, and there are thus several transfer stations, it is difficult to provide a polychromic image in which the differently colored images are perfectly superimposed.

SUMMARY OF THE INVENTION

It is therefore an object of the present invention to overcome the above drawbacks and to provide an improved multicolor electrocoagulation printing method and apparatus of reduced cost and cumbersomeness, capable of providing a polychromic image of high definition.

According to one aspect of the invention, there is provided a multicolor electrocoagulation printing method comprising the steps of:

a) providing a positive electrolytically inert electrode having a continuous passivated surface moving at substantially constant speed along a predetermined path, the passivated surface defining a positive electrode active surface;

b) coating the positive electrode active surface with an olefinic substance to form on the surface micro-droplets of olefinic substance;

c) forming on the olefin-coated positive electrode active surface a plurality of colored pixels representative of a desired polychromic image, each pixel comprising juxtaposed dots of differently colored, coagulated colloid; and d) bringing a substrate into contact with the colored pixels to cause transfer of the colored pixels from the positive electrode active surface onto the substrate and thereby imprint the substrate with the polychromic image.

Step (c) of the method according to the invention is carried out by:

i) providing a series of negative electrolytically inert electrodes each having a cylindrical configuration with a predetermined cross-sectional dimension and an end surface covered with a passive oxide film, the negative electrodes being electrically insulated from one another and arranged in rectilinear alignment so that the end surfaces thereof define a plurality of corresponding negative electrode active surfaces disposed in a plane spaced from the positive electrode active surface by a constant predetermined gap, the negative electrodes being spaced from one another by a distance smaller than the electrode gap;

ii) filling the electrode gap with an eletrocoagulation printing ink comprising a liquid colloidal dispersion containing an electrolytically coagulated colloid, a dispersing medium, a soluble electrolyte and a coloring agent;

iii) applying to the negative electrodes a pulsed bias voltage ranging from −1.5 to −40 volts and having a pulse duration of 15 nanoseconds to 6 microseconds, the bias voltage applied being inversely and non-linearly proportional to the pulse duration;

iv) applying to selected ones of the negative electrodes a trigger voltage sufficient to energize same and cause point-by-point selective coagulation and adherence of the colloid onto the olefin-coated positive electrode active surface opposite the electrode active surfaces of the energized electrodes while the positive electrode active surface is moving, thereby forming dots of colored, coagulated colloid;

v) removing any remaining non-coagulated colloid from the positive electrode active surface; and vi) repeating steps (i) through (v) several times to define a corresponding number of printing stages arranged at predetermined locations along the aforesaid path and each using a coloring agent of different color to produce dots of differently colored, coagulated colloid, the distance between the negative electrodes of each printing stage being at least three times the cross-sectional dimension of each negative electrode to permit juxtaposition of the dots of differently colored, coagulated colloid, thereby forming the colored pixels.

The present invention also provides, in another aspect thereof, an apparatus for carrying out a method as defined above. The apparatus of the invention comprises:

a positive electrolytically inert electrode having a continuous passivated surface defining a positive electrode active surface;

means for moving the positive electrode active surface at a substantially constant speed along a predetermined path;

means for coating the positive electrode active surface with an olefinic substance to form on the surface micro-droplets of olefinic substance;

a plurality of printing units arranged at predetermined locations along the path, each printing unit comprising:

a series of negative electrolytically inert electrodes each having a cylindrical configuration with a predetermined cross-sectional dimension and an end surface covered with a passive oxide film, the negative electrodes being electrically insulated from one another and arranged in rectilinear alignment so that the end surfaces thereof define a plurality of corresponding negative electrode active surfaces disposed in a plane spaced from the positive electrode active surface by a constant predetermined gap, the negative electrodes being spaced from one another by a distance smaller than the electrode gap;

means for filling the electrode gap with an eletrocoagulation printing ink comprising a liquid colloidal dispersion containing an electrolytically coagulated colloid, a dispersing medium, a soluble electrolyte and a coloring agent;

means for applying to the negative electrodes a pulsed bias voltage ranging from −1.5 to −40 volts and having a pulse duration of 15 nanoseconds to 6 microseconds, the bias voltage applied being inversely and non-linearly proportional to the pulse duration;

means for applying to selected ones of the negative electrodes a trigger voltage sufficient to energize same and cause point-by-point selective coagulation and adherence of the colloid onto the olefin-coated positive electrode active surface opposite the electrode active surfaces of the energized electrodes while the positive electrode active surface is moving, thereby forming dots of colored, coagulated colloid; and means for removing any remaining non-coagulated colloid from the positive electrode active surface;

wherein the printing units each use a coloring agent of different color so as to form a plurality of dots of differently colored, coagulated colloid on the olefin-coated positive electrode active surface, the distance between the negative electrodes of each printing unit being at least three times the cross-sectional dimension of each negative electrode to permit juxtaposition of the dots of differently colored, coagulated colloid, whereby to form a plurality of colored pixels representative of a desired polychromic image and each comprising juxtaposed dots of differently colored, coagulated colloid; and means for bringing a substrate into contact with the colored pixels to cause transfer of the colored pixels from the positive electrode active surface onto said substrate and thereby imprint the substrate with the polychromic image.

Applicant has found quite unexpectedly that by arranging the negative electrodes of each printing stage or unit so that the distance between the negative electrodes is at least three times the cross-sectional dimension of each negative electrode, colored pixels representative of a desired polychromic image and each comprising juxtaposed dots of differently colored, coagulated colloid can be formed on the positive electrode active surface. These colored pixels can thereafter be transferred from the positive electrode active surface onto the substrate at a single transfer station so as to imprint the substrate with the polychromic image. Moreover, a single positive electrode coating device is required for coating the positive electrode active surface with the olefinic substance.

The positive electrode which is used for electrocoagulation printing must be made of an electrolytically inert metal capable of releasing trivalent ions so that upon electrical energization of the negative electrodes, dissolution of the passive oxide film on such an electrode generates trivalent ions which then initiate coagulation of the colloid. Examples of suitable electrolytically inert metals include stainless steel, aluminium and tin.

As explained in Applicant's U.S. Pat. No. 5,750,593 of Mar. 12, 1998, the teaching of which is incorporated herein by reference, a breakdown of passive oxide films occurs in the presence of electrolyte anions, such as $Cl^-$, $Br^-$and $I^-$, there being a gradual oxygen displacement from the passive film by the halide anions and a displacement of adsorbed oxygen from the metal surface by the halide anions. The velocity of passive film breakdown, once started, increases explosively in the presence of an applied electric field. There is thus formation of a soluble metal halide at the metal surface. In other words, a local dissolution of the passive oxide film occurs at the breakdown sites, which releases metal ions into the electrolyte solution. Where a positive electrode made of stainless steel or aluminium is utilized in Applicant's electrocoagulation printing method, dissolution of the passive oxide film on such an electrode generates $Fe^{3+}$or $Al^{3+}$ions. These trivalent ions then initiate coagulation of the colloid.

The positive electrode can be in the form of a moving endless belt as described in Applicant's U.S. Pat. No. 4,661,222, or in the form of a revolving cylinder as described in Applicant's U.S. Pat. Nos. 4,895,629 and 5,538,601, the teachings of which are incorporated herein by reference. In the latter case, the printing stages or units are arranged around the positive cylindrical electrode. Preferably, the positive electrode active surface and the ink are maintained at a temperature of about 35–60° C., preferably 40° C., to increase the viscosity of the coagulated colloid in step (c) so that the dots of colored, coagulated colloid remain coherent during their transfer in step (d), thereby enhancing transfer of the colored, coagulated colloid onto the substrate. For example, the positive electrode active surface can be heated at the desired temperature and the ink applied on the heated electrode surface to cause a transfer of heat therefrom to the ink.

Coating of the positive electrode with an olefinic substance prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes. Applicant has found that it is no longer necessary to admix a metal oxide with the olefin substance; it is believed that the passive oxide film on currently available electrodes contains sufficient metal oxide to act as catalyst for the desired reaction.

Examples of suitable olefinic substances which may be used to coat the surface of the positive electrode in step (b) include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. Oleic acid is particularly preferred. The micro-droplets formed on the surface of the positive electrode active surface generally have a size ranging from about 1 to about $5\mu$.

The olefin-coated positive active surface is preferably polished to increase the adherence of the micro-droplets onto the positive electrode active surface, prior to step (c). For example, use can be made of a rotating brush provided with a plurality of radially extending bristles made of horsehair and having extremities contacting the surface of the positive electrode. The friction caused by the bristles contacting the surface upon rotation of the brush has been found to increase the adherence of the micro-droplets onto the positive electrode active surface.

Where the positive cylindrical electrode extends vertically, step (c)(ii) of the above electrocoagulation printing method is advantageously carried out by continuously discharging the ink onto the positive electrode active surface from a fluid discharge means disposed adjacent the electrode gap at a predetermined height relative to the positive electrode and allowing the ink to flow downwardly along the positive electrode active surface, the ink being thus carried by the positive electrode upon rotation thereof to the electrode gap to fill same. Preferably, excess ink flowing downwardly off the positive electrode active surface is collected and the collected ink is recirculated back to the fluid discharge means.

The colloid generally used is a linear colloid of high molecular weight, that is, one having a weight average molecular weight between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a weight average molecular weight of about 250,000 and sold by Cyanamid Inc. under the trade-mark ACCOSTRENGTH 85. Water is preferably used as the medium for dispersing the colloid to provide the desired colloidal dispersion.

The ink also contains a soluble electrolyte and a coloring agent. Preferred electrolytes include alkali metal halides and alkaline earth metal halides, such as lithium chloride, sodium chloride, potassium chloride and calcium chloride. Potassium chloride is particularly preferred. The coloring can be a dye or a pigment. Examples of suitable dyes which may be used to color the colloid are the water soluble dyes available from Hoechst such as Duasyn Acid Black for coloring in black and Duasyn Acid Blue for coloring in cyan, or those available from Riedel-Dehaen such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from Cabot Corp. such as Carbon Black Monarch® 120 for coloring in black, or those available from Hoechst such as Hostaperm Blue B2G or B3G for coloring in cyan, Permanent Rubine F6B or L6B for coloring in magenta and Permanent Yellow DGR or DHG for coloring in yellow. A dispersing agent is added for uniformly dispersing the pigment into the ink. Examples of suitable dispersing agents include the anionic dispersing agent sold by Boehme Filatex Canada Inc. under the trademark CLOSPERSE 25000.

In step (c) (iii), a pulsed bias voltage ranging from −1.5 to −40 volts and having a pulse duration of 15 nanoseconds to 6 microseconds is applied to the negative electrodes. As explained in Applicant's U.S. application Ser. No. 09/774,059, the teaching of which is incorporated herein by reference, this prevents undesirable formation of a gelatinous deposit on the surfaces of the negative electrodes, and of a low-density blur on the electrocoagulation printed image, while enabling the negative electrodes to be positioned close to one another with a spacing therebetween smaller than the electrode gap, without undergoing edge corrosion. If the pulsed bias voltage is less than −1.5 volts at a pulse duration of 6 microseconds, the passive oxide film of each negative electrode upon being energized dissolves into the ink, resulting in a release of metal ions and edge corrosion of the negative electrodes. On the other hand, if the pulsed bias voltage is greater than −40 volts at a pulse duration of 15 nanoseconds, such a voltage is sufficient to cause formation of the gelatinous deposit and low-density blur. If the pulse duration is shorter than 15 nanoseconds, the negative electrodes undergo edge corrosion and, if it is longer than 6 microseconds, there is formation of the gelatinous deposit and of the low-density blur. The pulse duration must therefore be insufficient for the bias voltage to cause formation of the gelatinous deposit and the low-density blur, yet sufficient for the bias voltage to protect the negative electrodes against edge corrosion. Thus, by operating with a pulsed bias voltage ranging from −1.5 to −40 volts and having a pulse duration of 15 nanoseconds to 6 microseconds, preferably about −2 volts at a pulse duration of 4 microseconds, and by positioning the negative electrodes sufficiently close to one another with a spacing therebetween smaller than the electrode gap, an image resolution as high as 400 lines per inch, or more, can be obtained without adverse effect. A trigger voltage is then applied in step (c) (iv) to selected ones of the negative electrodes to energize same and cause point-by-point selective coagulation and adherence of the colloid onto the olefin-coated positive electrode surface opposite the surfaces of the energized electrodes.

Preferably, the negative electrodes each have a cylindrical configuration with a circular cross-section and a diameter ranging from about 10 $\mu$m to about 50 $\mu$m. Electrodes having a diameter of about 15 $\mu$m are preferred. The gap which is defined between the positive and negative electrodes can range from about 35 $\mu$m to about 100 $\mu$m, the smaller the electrode gap the sharper are the dots of coagulated colloid produced. Where the electrode gap is of the order of 50 $\mu$m, the negative electrodes preferably have a diameter of about 15 $\mu$m and are spaced from one another by a distance of about 48 $\mu$m. Examples of suitable electrolytically inert metals from which the negative electrodes can be made include chromium, nickel, stainless steel and titanium; stainless steel is particularly preferred.

After coagulation of the colloid, any remaining non-coagulated colloid is removed from the positive electrode active surface, for example, by scraping the surface with a soft rubber squeegee, so as to fully uncover the colored, coagulated colloid. Preferably, the non-coagulated colloid thus removed is collected and mixed with the collected ink, and the collected non-coagulated colloid in admixture with the collected ink is recirculated back to the aforesaid fluid discharge means.

The optical density of the dots of colored, coagulated colloid may be varied by varying the voltage and/or pulse duration of the pulse-modulated signals applied to the negative electrodes.

After step (d), the positive electrode active surface is generally cleaned to remove therefrom any remaining coagulated colloid. According to a preferred embodiment, the positive electrode is rotatable in a predetermined direction and any remaining coagulated colloid is removed from the positive electrode active surface by providing an elongated rotatable brush extending parallel to the longitudinal axis of the positive electrode, the brush being provided with a plurality of radially extending bristles made of horsehair and having extremities contacting the positive electrode active surface, rotating the brush in a direction opposite to the direction of rotation of the positive electrode so as to cause the bristles to frictionally engage the positive electrode active surface, and directing jets of cleaning liquid under pressure against the positive electrode active surface, from either side of the brush. In such an embodiment, the positive electrode active surface and the ink are preferably maintained at a temperature of about 35–60° C. by heating the cleaning liquid to thereby heat the positive electrode active surface upon contacting same and applying the ink on the heated electrode surface to cause a transfer of heat therefrom to the ink.

BRIEF DESCRIPTION OF THE DRAWINGS

Further features and advantages of the invention will become more readily apparent from the following description of a preferred embodiment as illustrated by way of examples in the accompanying drawings, in which.

DESCRIPTION OF PREFERRED EMBODIMENT

Figure 1:
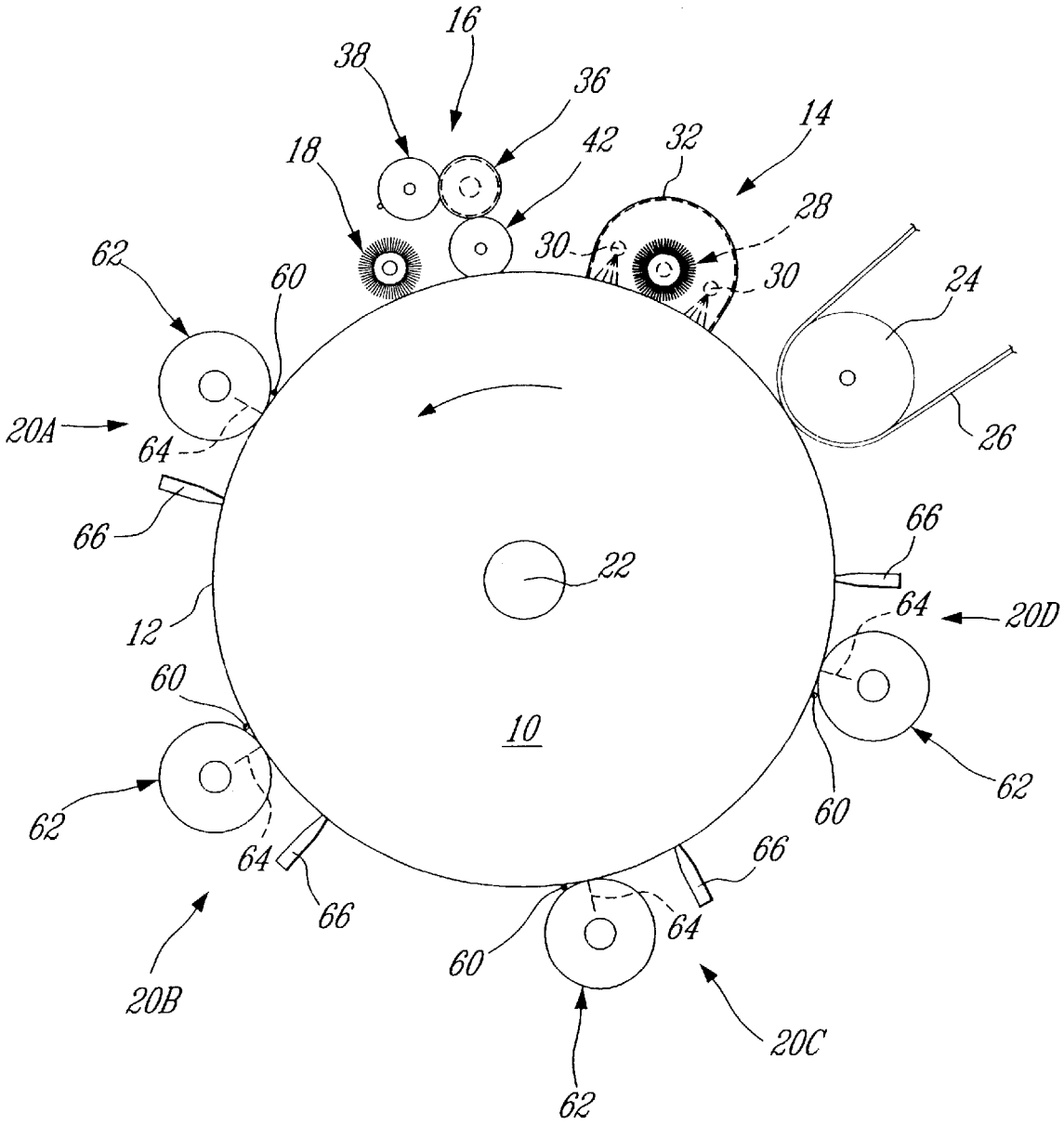
FIG. 1 is a schematic top plan view of a multicolor electrocoagulation printing apparatus according to a preferred embodiment of the invention, comprising four printing units each using a coloring agent of different color.

Referring first to FIG. 1, there is illustrated a multicolor electrocoagulation printing apparatus comprising a central positive electrode 10 in the form of a revolving cylinder and having a passivated surface 12, around which are arranged a positive electrode cleaning device 14 for cleaning the surface 12, a positive electrode coating device 16 for coating the surface 12 with an olefinic substance, a polishing brush 18 for polishing the olefin-coated surface 12 and four identical printing units 20 adapted to form on the olefin-coated surface 12 a plurality of colored pixels representative of a desired polychromic image, each pixel comprising juxtaposed dots of differently colored, coagulated colloid. The first printing unit 20A is adapted to produce dots of coagulated colloid having a black color, the second printing unit 20B to produce dots of coagulated colloid having a yellow color, the third printing 20C to produce dots of coagulated colloid having a magenta color and the fourth printing unit to produce dots of coagulated colloid having a cyan color. The cylindrical electrode 10 extends vertically and has a shaft 22 which is driven by a motor (not shown) for rotating the electrode about a vertical axis coincident with the shaft 22. The apparatus further includes a pressure roller 24 for bringing a substrate in the form of a continuous web 26 into contact with the colored pixels to cause transfer of the colored pixels from the positive electrode surface 12 onto the web 26 and thereby imprint the web with the polychromic image.

Figure 2:
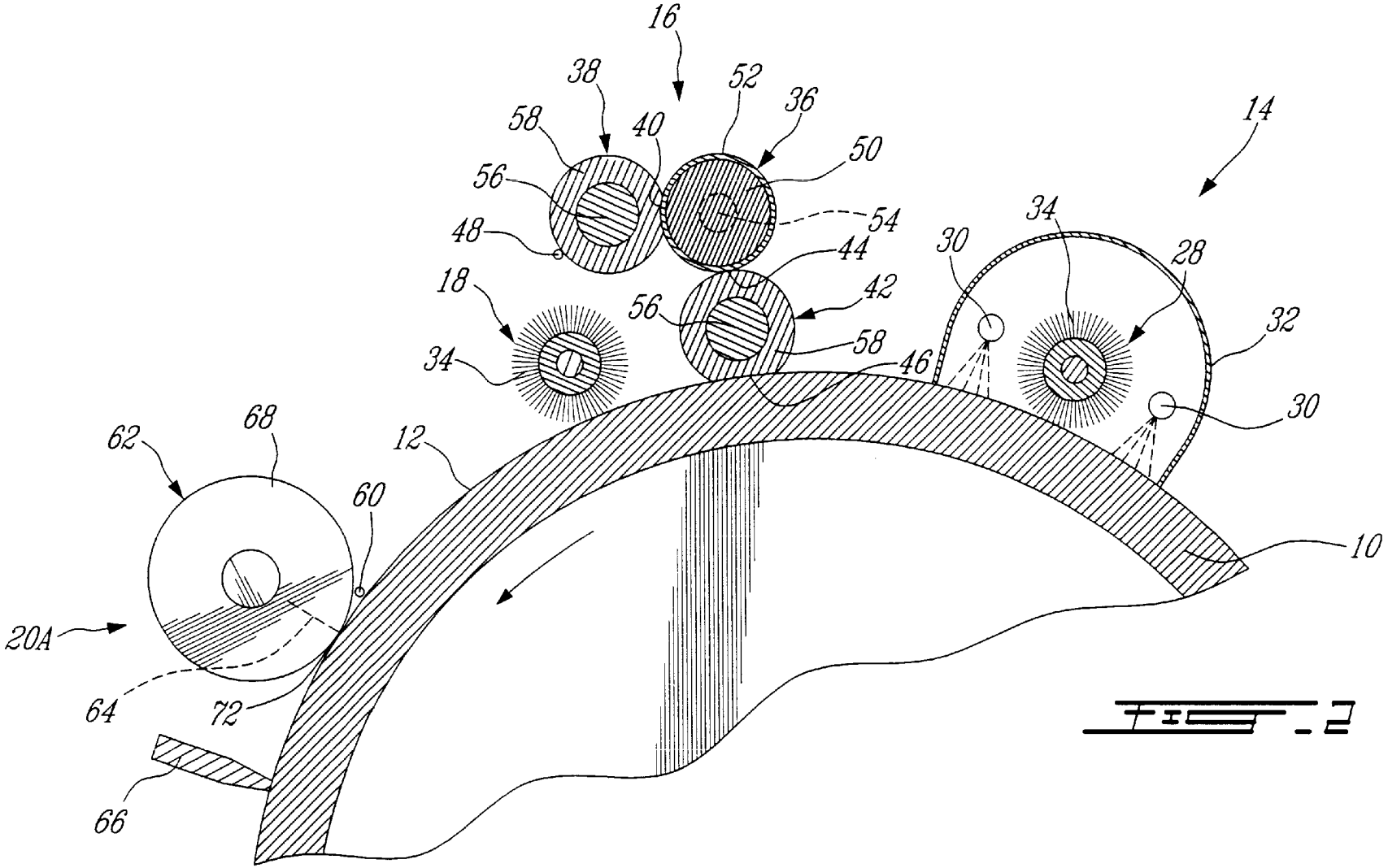
FIG. 2 is a fragmentary sectional view thereof, showing one of the printing units together with a positive electrode coating device and cleaning device.

As best shown in FIG. 2, the positive electrode cleaning device 14 comprises a rotating brush 28 and two high pressure water injectors 30 arranged in a housing 32. The brush 28 is provided with a plurality of radially extending bristles 34 made of horsehair and having extremities contacting the surface 12 of the positive electrode 10. Any coagulated colloid remaining on the surface 12 after transfer of the colored pixels onto the web 26 is thus removed by the brush 28 and washed away by the powerful jets of water produced by the injectors 30.

The positive electrode coating device 16 comprises a vertically extending distribution roller 36, an applicator roller 38 extending parallel to the distribution roller 36 and in pressure contact engagement therewith to form a nip 40, and a transfer roller 42 extending parallel to the roller 36 and in contact engagement therewith to form a nip 44. The transfer roller 42 is in pressure contact engagement with the positive electrode 10 to form a nip 46 and permit the roller 42 to be driven by the positive electrode 10 upon rotation thereof. The coating device 16 further includes a feeding device 48 for supplying to the applicator roller 38 the olefinic substance in the form of an oily liquid.

The distribution roller 36 has a solid core 50 of metal provided with a peripheral coating 52 of oxide ceramic material. A pair of stub shafts 54 (only one shown) integral with the core 50 extends outwardly from the extremities of the roller 36. The applicator roller 38 and transfer roller 42 also have a solid core 56 of metal, but are provided with a peripheral covering 58 of polyurethane. The rollers 36 and 38 are rotated in register by means of a motor (not shown) driving the shaft 54 of the distribution roller 36. The drive from the motor rotates the distribution roller 36 in a counterclockwise manner, which in turn transmits a clockwise rotation to the applicator roller 38.

The feeding device 48 is adapted to discharge the oily liquid onto the applicator roller 38 at an upper portion thereof. The liquid then flows downwardly under gravity along the roller 38 and is carried to the nip 40 by the roller 38 during rotation thereof. The liquid upon passing through the nip 40 forms a film uniformly covering the surface of the ceramic coating 52 of the distribution roller 36, the film breaking down into micro-droplets containing the olefinic substance and having substantially uniform size and distribution. The micro-droplets formed on the roller 36 are carried by the latter to the nip 44 where they are transferred onto the transfer roller 42. The micro-droplets are then carried by the roller 42 to the nip 46 where they are transferred onto the positive electrode 10.

The polishing brush 18 used for polishing the olefin-coated surface 12 of the positive electrode 10 is similar to the brush 28, the brush 18 being provided with a plurality of radially extending bristles 34 made of horsehair and having extremities contacting the surface 12. The friction caused by the bristles 34 contacting the surface 12 upon rotation of the brush 18 has been found to increase the adherence of the micro-droplets onto the positive electrode surface 12.

Figure 3:
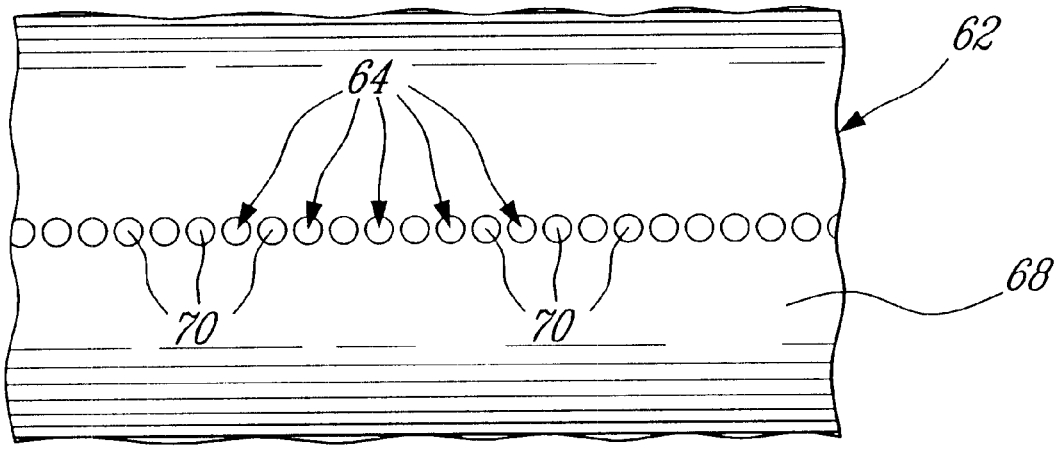
FIG. 3 is a fragmentary longitudinal view of the printing head of one of the printing unit.

The printing units 20 each comprise a device 60 for discharging an electrocoagulation printing ink onto the olefin-coated surface 12, a printing head 62 provided with negative electrodes 64 for electrocoagulating the colloid present in the ink to form on the olefin-coated surface 12 dots of colored, coagulated colloid and a soft rubber squeegee 66 for removing any remaining non-coagulated colloid from the surface 12. The electrocoagulation printing ink consists of a colloidal dispersion containing an electrolytically coagulable colloid, a dispersing medium, a soluble electrolyte and a coloring agent. As shown in FIG. 3, each printing head 62 comprises a cylindrical electrode carrier 68 with the negative electrodes 64 being electrically insulated from one another and arranged in rectilinear alignment along the length of the electrode carrier 68 to define a plurality of corresponding negative electrode active surfaces 70. Each printing head 62 is positioned relative to the positive electrode 10 such that the surfaces 70 of the negative electrodes 64 are disposed in a plane which is spaced from the positive electrode surface 12 by a constant predetermined gap 72. The electrodes 64 are also spaced from one another by a distance smaller than the electrode gap 72 to increase image resolution. The device 60 is positioned adjacent the electrode gap 72 to fill same with the electrocoagulation printing ink.

Figure 4:
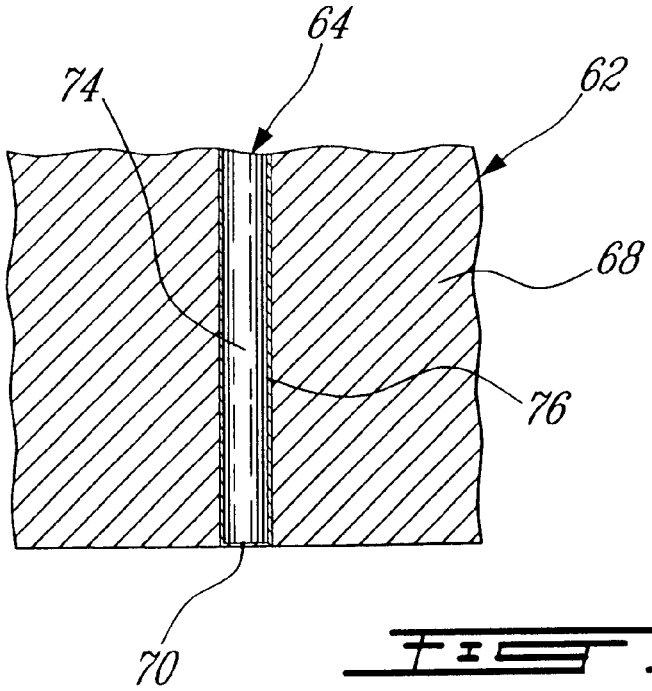
FIG. 4 is a fragmentary sectional view of the printing head illustrated in FIG. 3, showing one of the negative electrodes.

As shown in FIG. 4, the negative electrodes 64 each have a cylindrical body 74 made of an electrolytically inert metal and covered with a passive oxide film 76. The end surface of the electrode body 74 covered with such a film defines the aforementioned negative electrode active surface 70.

Figure 5:
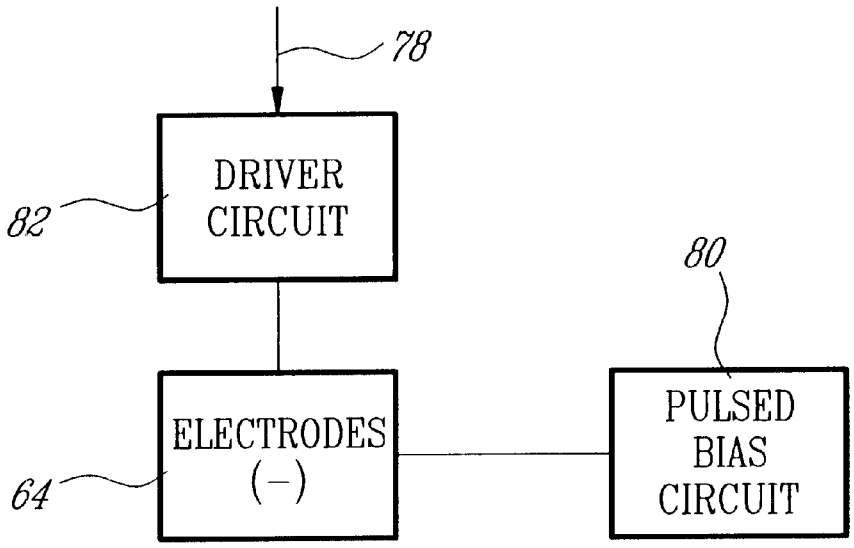
FIG. 5 is a schematic diagram showing how the negative electrodes of each printing head one energized in response to an input signal of information.

FIG. 5 is a schematic diagram illustrating how the negative electrodes 64 of each printing head 62 are energized in response to an input signal of information 78 to form dots of colored, coagulated colloid. A pulsed bias circuit 80 is provided for applying to the negative electrodes 64 a pulsed bias voltage ranging from −1.5 to −40 volts and having a pulse duration of 15 nanoseconds to 6 microseconds. The pulsed bias voltage applied by the circuit 80 to the negative electrodes 64 is inversely and non-linearly proportional to the pulse duration. A driver circuit 82 is also used for addressing selected ones of the electrodes 64 so as to apply a trigger voltage to the selected electrodes and energize same. Such an electrical energizing causes point-by-point selective coagulation and adherence of the colloid onto the olefin-coated surface 12 of the positive electrode 10 opposite the electrode active surfaces 70 of the energized electrodes 64 while the electrode 10 is rotating, thereby forming on the surface 12 a series of corresponding dots of colored, coagulated colloid. The driver circuit 82 associated with each printing unit 20 is connected to a central processing unit (not shown).

The first printing unit 20A utilizes an ink containing a black coloring agent to produce dots of coagulated colloid having a black color. The second printing unit 20B utilizes an ink containing a yellow coloring agent to produce dots of coagulated colloid having a yellow color. The third printing unit 20C utilizes an ink containing a magenta coloring agent to produce dots of coagulate colloid having a magenta color. The fourth printing unit 20D utilizes an ink containing a cyan coloring agent to produce dots of coagulated colloid having a cyan color. The distance between the negative electrodes 64 of each printing unit 20 is at least three times the diameter of each electrode 64 to permit juxtaposition of the dots of differently colored, coagulated colloid during their formation on the surface 12 of the positive electrode 10. Since electrocoagulation of the colloid present in the ink between the positive electrode surface 12 and the negative electrode active surface 70 of an energized negative electrode 64 follows the lowest electrolytic resistive path between the surfaces 12 and 70, coagulation of the colloid will occur on a free area of the surface 12 next to a previously formed dot of differently colored, coagulated colloid even if the free area of the positive electrode surface 12 is not perfectly opposite the negative electrode active surface 70 of the energized electrode 64. As a result, a plurality of colored pixels representative of a desired polychromic image are formed on the positive electrode surface 12, each pixel comprising juxtaposed dots of differently colored, coagulated colloid.

Figure 6:
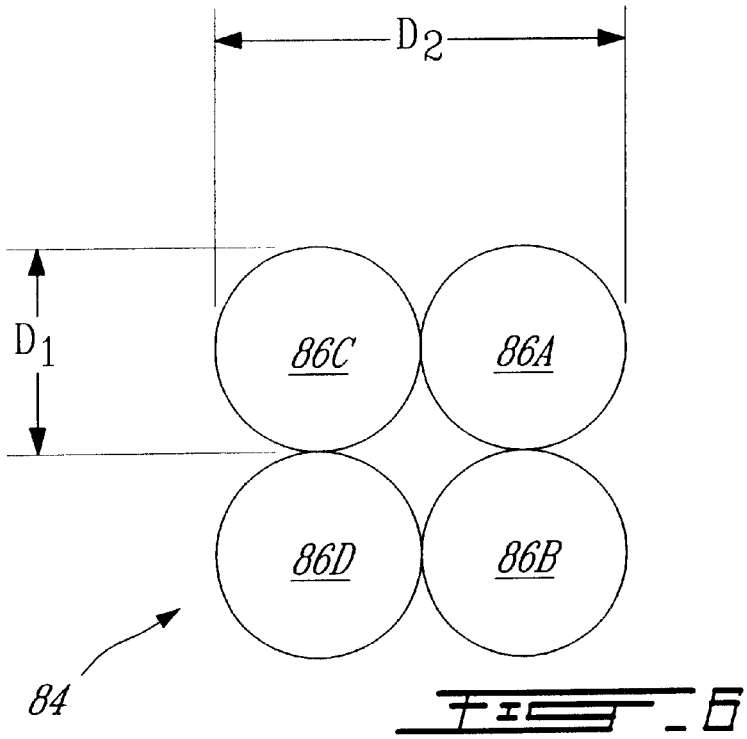
FIG. 6 is an enlarged top plan view of a colored pixel formed by the multicolor electrocoagulation printing apparatus illustrated in FIG. 1.

FIG. 6 is an enlarged top plan view of a typical pixel 84 as formed on the surface 12 of the positive electrode 10. The pixel 84 comprises a dot 86A of coagulated colloid having a black color produced by the printing unit 20A, a dot 86B of coagulated colloid having a yellow color produced by the printing unit 20B, a dot 86C of coagulated colloid having a magenta color produced by the printing unit 20C, and a dot 86D of coagulated colloid having a cyan color produced by the printing of unit 20D. The dots 86A, 86B, 86C and 86D are juxtaposed to one another and typically each have a diameter D1 of about 30 $\mu$m when the negative electrodes 64 of the printing units 20 each have a diameter of about 15 $\mu$m. The colored pixel 84 has a dimension D2 of about 60 $\mu$m.

The colored pixels 84 are transferred by means of the pressure roller 24 from the positive electrode surface 12 onto the web 26 so as to imprint the web with the polychromic image. A polychromic image having a high definition as well as a resolution as high as 400 lines per inch, or more, can thus be obtained.

We claim:

1. A multicolor electrocoagulation printing method comprising the steps of:

a) providing a positive electrolytically inert electrode having a continuous passivated surface moving at substantially constant speed along a predetermined path, said passivated surface defining a positive electrode active surface;

b) coating said positive electrode active surface with an olefinic substance to form on the surface micro-droplets of olefinic substance;

c) forming on the olefin-coated positive electrode active surface a plurality of colored pixels representative of a desired polychromic image, each pixel comprising juxtaposed dots of differently colored, coagulated colloid, step (c) being carried out by:

i) providing a series of negative electrolytically inert electrodes each having a cylindrical configuration with a predetermined cross-sectional dimension and an end surface covered with a passive oxide film, the negative electrodes being electrically insulated from one another and arranged in rectilinear alignment so that the end surfaces thereof define a plurality of corresponding negative electrode active surfaces disposed in a plane spaced from the positive electrode active surface by a constant predetermined gap, said negative electrodes being spaced from one another by a distance smaller than the electrode gap;

ii) filling the electrode gap with an eletrocoagulation printing ink comprising a liquid colloidal dispersion containing an electrolytically coagulated colloid, a dispersing medium, a soluble electrolyte and a coloring agent;

iii) applying to the negative electrodes a pulsed bias voltage ranging from −1.5 to −40 volts and having a pulse duration of 15 nanoseconds to 6 microseconds, the bias voltage applied being inversely and non-linearly proportional to the pulse duration;

iv) applying to selected ones of said negative electrodes a trigger voltage sufficient to energize same and cause point-by-point selective coagulation and adherence of the colloid onto the olefin-coated positive electrode active surface opposite the electrode active surfaces of said energized electrodes while said positive electrode active surface is moving, thereby forming dots of colored, coagulated colloid;

v) removing any remaining non-coagulated colloid from said positive electrode active surface; and vi) repeating steps (i) through (v) several times to define a corresponding number of printing stages arranged at predetermined locations along said path and each using a coloring agent of different color to produce dots of differently colored, coagulated colloid, the distance between the negative electrodes of each printing stage being at least three times the cross-sectional dimension of each negative electrode to permit juxtaposition of said dots of differently colored, coagulated colloid, thereby forming said colored pixels; and d) bringing a substrate into contact with the colored pixels to cause transfer of said colored pixels from the positive electrode active surface onto said substrate and thereby imprint said substrate with said polychromic image.

2. A method as claimed in claim 1, wherein said negative electrodes each have a circular cross-section with a diameter ranging from about 10 to about 50 $\mu$m.

3. A method as claimed in claim 2, wherein said electrode gap ranges from about 35 to about 100 $\mu$m.

4. A method as claimed in claim 3, wherein said electrode gap is about 50 $\mu$m.

5. A method as claimed in claim 4, wherein said negative electrodes each have a diameter of about 15 $\mu$m and are spaced from one another by a distance of about 48 $\mu$m.

6. A method as claimed in claim 1, wherein a pulsed bias voltage of about −2 volts with a pulse duration of 4 microseconds is applied to said negative electrodes.

7. A method as claimed in claim 1, wherein said negative electrodes are formed of an electrolytically inert metal selected from the group consisting of chromium, nickel, stainless steel and titanium.

8. A method as claimed in claim 7, wherein said electrolytically inert metal comprises stainless steel.

9. A method as claimed in claim 1, wherein said positive electrode is a cylindrical electrode having a central longitudinal axis and rotating at substantially constant speed about said longitudinal axis, and wherein said printing stages are arranged around said positive cylindrical electrode.

10. A method as claimed in claim 9, wherein said positive electrode is formed of stainless steel.

11. A method as claimed in claim 1, wherein after step (d), any remaining coagulated colloid is removed from the positive electrode active surface.

12. A multicolor electrocoagulation printing apparatus comprising:

a positive electrolytically inert electrode having a continuous passivated surface defining a positive electrode active surface;

means for moving said positive electrode active surface at a substantially constant speed along a predetermined path;

means for coating said positive electrode active surface with an olefinic substance to form on the surface micro-droplets of olefinic substance;

a plurality of printing units arranged at predetermined locations along said path, each printing unit comprising:

a series of negative electrolytically inert electrodes each having a cylindrical configuration with a predetermined cross-sectional dimension and an end surface covered with a passive oxide film, the negative electrodes being electrically insulated from one another and arranged in rectilinear alignment so that the end surfaces thereof define a plurality of corresponding negative electrode active surfaces disposed in a plane spaced from the positive electrode active surface by a constant predetermined gap, said negative electrodes being spaced from one another by a distance smaller than the electrode gap;

means for filling the electrode gap with an eletrocoagulation printing ink comprising a liquid colloidal dispersion containing an electrolytically coagulated colloid, a dispersing medium, a soluble electrolyte and a coloring agent;

means for applying to the negative electrodes a pulsed bias voltage ranging from −1.5 to −40 volts and having a pulse duration of 15 nanoseconds to 6 microseconds, the bias voltage applied being inversely and non-linearly proportional to the pulse duration;

means for applying to selected ones of said negative electrodes a trigger voltage sufficient to energize same and cause point-by-point selective coagulation and adherence of the colloid onto the olefin-coated positive electrode active surface opposite the electrode active surfaces of said energized electrodes while said positive electrode active surface is moving, thereby forming dots of colored, coagulated colloid; and means for removing any remaining non-coagulated colloid from said positive electrode active surface;

wherein said printing units each use a coloring agent of different color so as to form a plurality of dots of differently colored, coagulated colloid on the olefin-coated positive electrode active surface; the distance between the negative electrodes of each printing unit being at least three times the cross-sectional dimension of each negative electrode to permit juxtaposition of said dots of differently colored, coagulated colloid, thereby forming a plurality of colored pixels representative of a desired polychromic image and each comprising juxtaposed dots of differently colored, coagulated colloid; and means for bringing a substrate into contact with the colored pixels to cause transfer of said colored pixels from the positive electrode active surface onto said substrate and thereby imprint said substrate with said polychromic image.

13. An apparatus as claimed in claim 12, wherein said negative electrodes each have a circular cross-section with a diameter ranging from about 10 to about 50 $\mu$m.

14. An apparatus as claimed in claim 13, wherein said electrode gap ranges from about 35 to about 100 $\mu$m.

15. An apparatus as claimed in claim 14, wherein said electrode gap is about 50 $\mu$m.

16. An apparatus as claimed in claim 15, wherein said negative electrodes each have a diameter of about 15 $\mu$m and are spaced from one another by a distance of about 48 $\mu$m.

17. An apparatus as claimed in claim 12, wherein said negative electrodes are formed of an electrolytically inert metal selected from the group consisting of chromium, nickel, stainless steel and titanium.

18. An apparatus as claimed in claim 17, wherein said electrolytically inert metal comprises stainless steel.

19. An apparatus as claimed in claim 12, wherein said positive electrode is a cylindrical electrode having a central longitudinal axis and wherein said means for moving said positive electrode active surface includes means for rotating said positive cylindrical electrode about said longitudinal axis, said printing units being arranged around said positive cylindrical electrode.

20. An apparatus as claimed in claim 19, wherein said positive electrode is formed of stainless steel.

21. An apparatus as claimed in claim 12, further including cleaning means for removing any remaining coagulated colloid from the positive electrode active surface, said cleaning means being arranged downstream of said means for bringing the substrate into contact with the colored pixels.

* * * * *